US006004218A

United States Patent [19]

Keating et al.

[11] Patent Number: 6,004,218

[45] Date of Patent: Dec. 21, 1999

[54] PORTABLE WALL BOARD SYSTEM AND METHOD FOR USING SAME

[75] Inventors: Stephen Keating, Willowdale; Neal C. Gollob, Waterloo, both of Canada

[73] Assignee: Roller Drome, LLC, Las Vegas, Nev.

[21] Appl. No.: 08/802,952

[22] Filed: Feb. 21, 1997

[30] Foreign Application Priority Data

Feb. 23, 1996 [CA] Canada ..... 2170198

[51] Int. Cl.[6] ..... A63G 33/00

[52] U.S. Cl. ..... 472/94; 256/24

[58] Field of Search ..... 472/92, 93, 94; 256/24, 25, 26, 27, 20; 52/282.1, 592.1, 592.3

[56] References Cited

U.S. PATENT DOCUMENTS

| | | | |
|---|---|---|---|
| D. 349,738 | 8/1994 | Naegele, III et al. . | |
| 2,982,380 | 5/1961 | Rose | 52/592.1 X |
| 3,228,161 | 1/1966 | McCown | 52/282.1 |
| 3,844,539 | 10/1974 | Abbott | 472/94 X |
| 3,883,120 | 5/1975 | Tippmann | 472/94 X |
| 4,271,622 | 6/1981 | Tippmann et al. | 256/24 X |
| 4,927,134 | 5/1990 | Burley | 472/94 X |
| 5,702,090 | 12/1997 | Edgmann | 256/19 |

FOREIGN PATENT DOCUMENTS

| | | |
|---|---|---|
| 2104574 | 2/1994 | Canada . |
| 2117703 | 5/1995 | Canada . |
| 2172908 | 10/1996 | Canada . |
| 2151430 | 12/1996 | Canada . |
| 2166587 | 6/1997 | Canada . |

*Primary Examiner*—Kien T. Nguyen
*Attorney, Agent, or Firm*—Bereskin & Parr

[57] ABSTRACT

A portable wall board system is provided for enclosing a playing area such as a roller hockey rink. The wall board system includes panels and supports having corresponding keys and keyways that interlock to form a continuous inner wall for the playing surface. The system further includes doors that interlock with the supports at desired locations. The supports are hollow in order to receive a ballast material such as water. The invention also provides a method for enclosing a playing area using the above elements.

24 Claims, 13 Drawing Sheets

PORTABLE WALL BOARD SYSTEM AND METHOD FOR USING SAME

FIELD OF THE INVENTION

This invention relates to a portable wall board system and method for enclosing a sports playing area. It is particularly suitable for use as a rink board enclosure for a roller hockey rink.

BACKGROUND OF THE INVENTION

The recent popularity of in-line roller skates has spawned many new sports, including roller hockey. Roller hockey is particularly popular because it can be played in both warm and cold climates and thus has a wider potential geographic appeal than ice hockey. Roller hockey can be played on any flat, relatively smooth surface such as a parking lot or other paved surface. The game is enhanced if an enclosure similar to ice hockey rink boards encloses the rink.

One method of enclosing a roller hockey rink is to use conventional ice hockey rink boards, known as dasher boards. Conventional dasher boards, however, have the disadvantage of being costly to obtain as well as time-consuming and difficult to install. Furthermore, the materials used in the construction of conventional dasher boards, typically wood and steel, are too heavy to make them conveniently portable. Portability has become increasingly important over the past few years with the advent of roller hockey tournaments that travel from site to site. At the conclusion of such a tournament, which typically lasts a day or a weekend, organizers pack up the tournament equipment, including the rink board system, load it onto a truck and head to a new location to conduct a similar tournament.

One known form of portable rink board system uses an inflatable wall which encloses the rink. While having the advantage of being portable when deflated, this type of system is expensive and requires the use of electric inflating machines to assemble the system. Furthermore, the system is vulnerable to inadvertent leaks and punctures, necessitating special care and maintenance. Also, the inflated walls of the system do not adequately mimic the hardness of the walls of a conventional hockey rink. This affects the flight of pucks or balls that deflect from the walls during regular play.

Another form of portable rink board system is shown in U.S. Pat. No. D349,738. This system incorporates vinyl-wrapped foam barriers that are placed around the rink. This type of system, however, does not accurately reproduce the shape or response of ice hockey dasher boards, and therefore sacrifices performance for affordability and portability.

Accordingly, there is a need for a wall board system for roller hockey rinks which is quick and easy to assemble, relatively inexpensive to produce and which accurately reproduces the shape and deflection response of conventional ice hockey dasher boards.

SUMMARY OF THE INVENTION

The present invention provides a system and method for portably and inexpensively enclosing a sports playing surface, such as an in-line hockey rink.

In a first aspect, the invention provides a wall board system for enclosing an area, comprising:

a plurality of panels each having a front face and at least two end faces;

a plurality of supports each having a front face and at least two side faces, wherein said supports are generally hollow for receiving a ballast material; and means for interconnecting said end faces of said panels to said side faces of said supports to align said panel front faces and said support front faces to define a substantially continuous inner wall for enclosing said area.

In another aspect, the invention provides a wall board system for enclosing an area, comprising;

a plurality of panels each having a front face and at least two end faces;

a plurality of supports each having a front face and at least two side faces; and a system of interconnecting keys and keyways integrally formed on said panels and said supports to align said panel front faces and said support front faces to define a substantially continuous inner wall for enclosing said area.

In another aspect, the invention provides a wall board system for enclosing an area, comprising:

a plurality of panels each having a front face and at least two end faces;

a plurality of supports each having a front face and at least two side faces;

means for interconnecting said end faces of said panels to said side faces of said supports to align said panel front faces and said support front faces to define a substantially continuous inner wall for enclosing said area; and wherein said panels and said supports are each formed as a single piece of molded plastic.

In another aspect, the invention provides a wall board system for enclosing an area, comprising:

a plurality of panels each having a front face and at least two end faces;

a plurality of supports each having a front face and at least two side faces;

means for interconnecting said end faces of said panels to said side faces of said supports to align said panel front faces and said support front faces to define a substantially continuous inner wall for enclosing said area; and at least one door having a front face, first and second end faces, and means for pivotally connecting said first end face of said door to one of said supports along a vertical axis to align said door front face with said panel front face and said support front face to define said continuous inner wall In another aspect, the invention provides a wall board system for enclosing an area, comprising a plurality of panels each having a front face and at least two end faces;

a plurality of supports each having a front face and at least two side faces;

means for interconnecting said end faces of said panels to said side faces of said supports to align said panel front faces and said support front faces to define a substantially continuous inner wall for enclosing said area; and a shielding system having at least one shield and a plurality of shield support means, said shield support means interconnecting with said supports to define an upper wall that extends generally co-planar to said continuous inner wall along at least a portion of the circumference of said enclosed area.

In another aspect, the invention provides a support for a wall panel comprising:

a hollow body having a base portion and a post portion, said post portion being generally orthogonal to said base portion and having a front face and at least two side faces;

a brace portion extending diagonally between said post portion and said base portion;

integral interconnection means located on said side faces of said post portion for interconnecting with corresponding interconnection means on a wall panel; and wherein said hollow body is adapted to receive a ballast material.

In another aspect, the invention provides a support for a wall panel comprising:

a hollow body having a base portion and a post portion, said post portion being generally orthogonal to said base portion and having a front face and at least two side faces;

integral interconnection means located on said side faces of said post portion for interconnecting with a wall panel, wherein said interconnection means comprises upper and lower keyways that are defined in said side faces adjacent each said post portion for receiving at least two corresponding upper and lower keys on said wall panel; and wherein said hollow body is adapted to receive a ballast material.

This aspect of the invention provides a lightweight portable device which can be filled with water or other ballast to improve the support characteristics of the device.

In another aspect, the invention provides a wall panel for a wall board system comprising:

a monolithic panel having at least two end faces;

integral interconnection means located on said end faces of said panel for engaging corresponding interconnection means on a support for said wall panel; and wherein said panel is formed as a single hollow piece of molded plastic.

Advantageously, this aspect of the invention provides a lightweight panel which is easily transportable.

In another aspect, the invention provides a method for enclosing an area with a modular wall board system comprising the following steps:

determining the size of the desired area to be enclosed;

obtaining a plurality of panels each having a front face, a plurality of supports and means for interconnecting said panels to said supports to align said panel front faces;

interconnecting said panels and said supports with said interconnection means to align said front faces of said panels to define a continuous inner wall for enclosing said area; and inserting at least one door and at least one door brace between a pair of supports for facilitating entry and exit from said area.

By using water or other readily available substance as a ballast, this aspect of the invention allows a sturdy, strong enclosure to be assembled from light, portable elements.

Further aspects of the invention will appear from the following description, taken together with the accompanying drawings.

BRIEF DESCRIPTION OF THE DRAWINGS

For a better understanding of the present invention, and to show more clearly how it may be carried into effect, reference will now be made, by way of example, to the accompanying drawings. The drawings show a preferred embodiment of the present invention, in which.

DETAILED DESCRIPTION OF THE PREFERRED EMBODIMENTS

Figure 1:
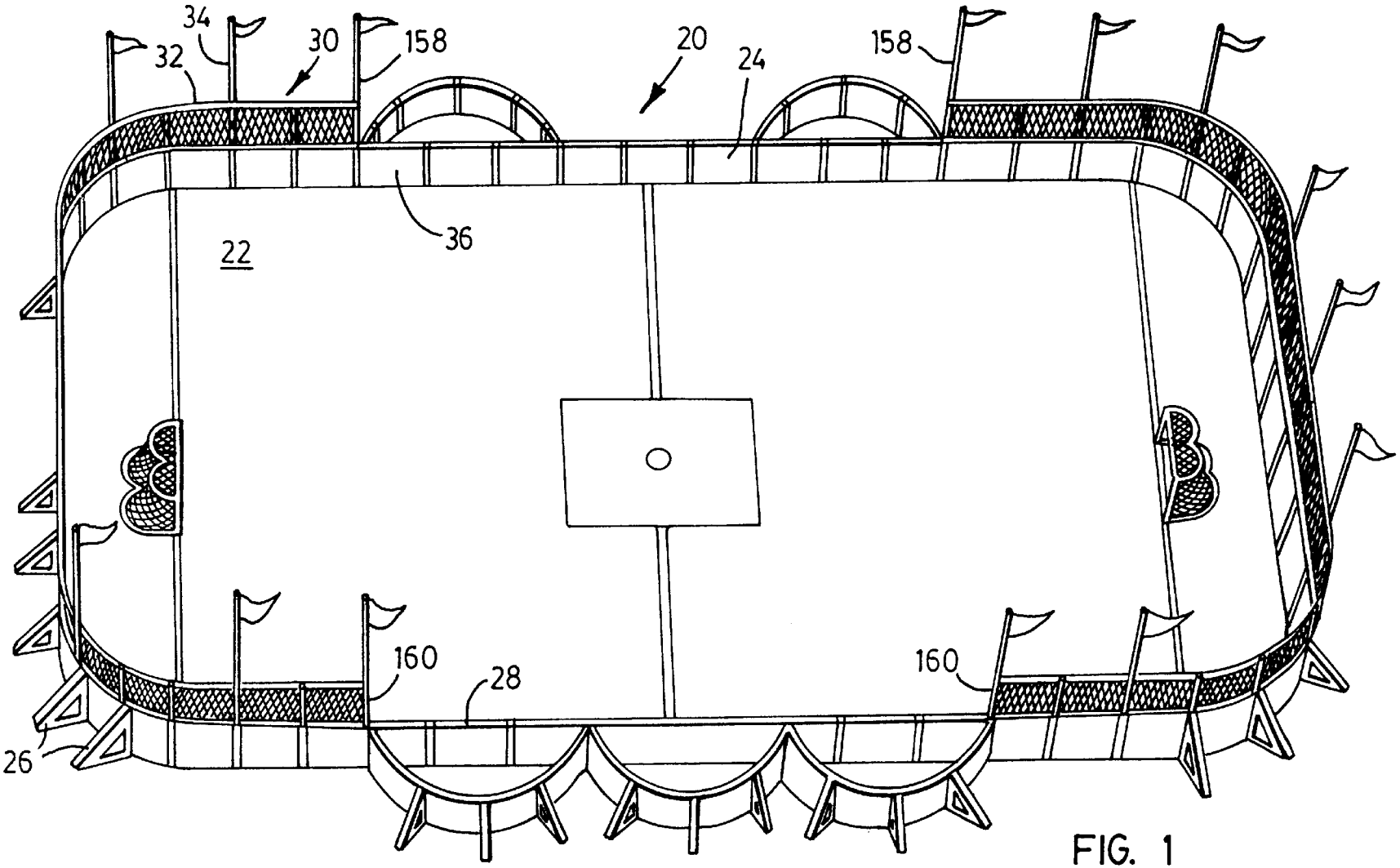
FIG. 1 is an isometric view of a wall board system in accordance with the present invention.

Referring to FIG. 1, a wall board system in accordance with the present invention is indicated generally at 20. The system is depicted enclosing a playing surface 22, in this case a roller hockey rink.

The wall board system 20 includes panels 24, supports 26, doors 28 and a shielding system, indicated generally at 30. The shielding system 30 includes shields 32 and shield support posts 34. The panels 24, supports 26 and door 28 interconnect to define a continuous inner wall 36 that surrounds the playing surface 22 for the purpose of preventing a ball or puck from leaving the playing surface 22. The playing surface 22 can be any relatively flat, smooth, hard surface on which a roller skater may skate such as an asphalt parking lot, or the like, or a specially-designed synthetic surface may be used (such as is commercially available from Sport Court Inc. of Salt Lake City, Utah, U.S.A.).

The interconnected panels 24 smoothly and contiguously encircle the playing surface 22 such that a ball or puck cannot become lodged underneath a panel or between two adjacent panels 24, or otherwise escape from the playing area except by exiting over the top of the wall board system 20 or shielding system 30. In a preferred embodiment two configurations of panels 24 are used: a straight type 24*a* and a curved type 24*b*. The panel types 24*a* and 24*b* are preferably identical except that type 24*b* curves inwardly at a fixed radius along its length. A fixed radius of between fourteen to sixteen feet is preferred if the enclosure system is to be used with a playing area having a preferred roller hockey rink size (140 feet by 65 feet, with 14 foot radius corners). This rink size is smaller than standard ice hockey rinks but is preferred for roller hockey games where four players (excluding the goalie) are playing for a team at one time.

Figure 2:
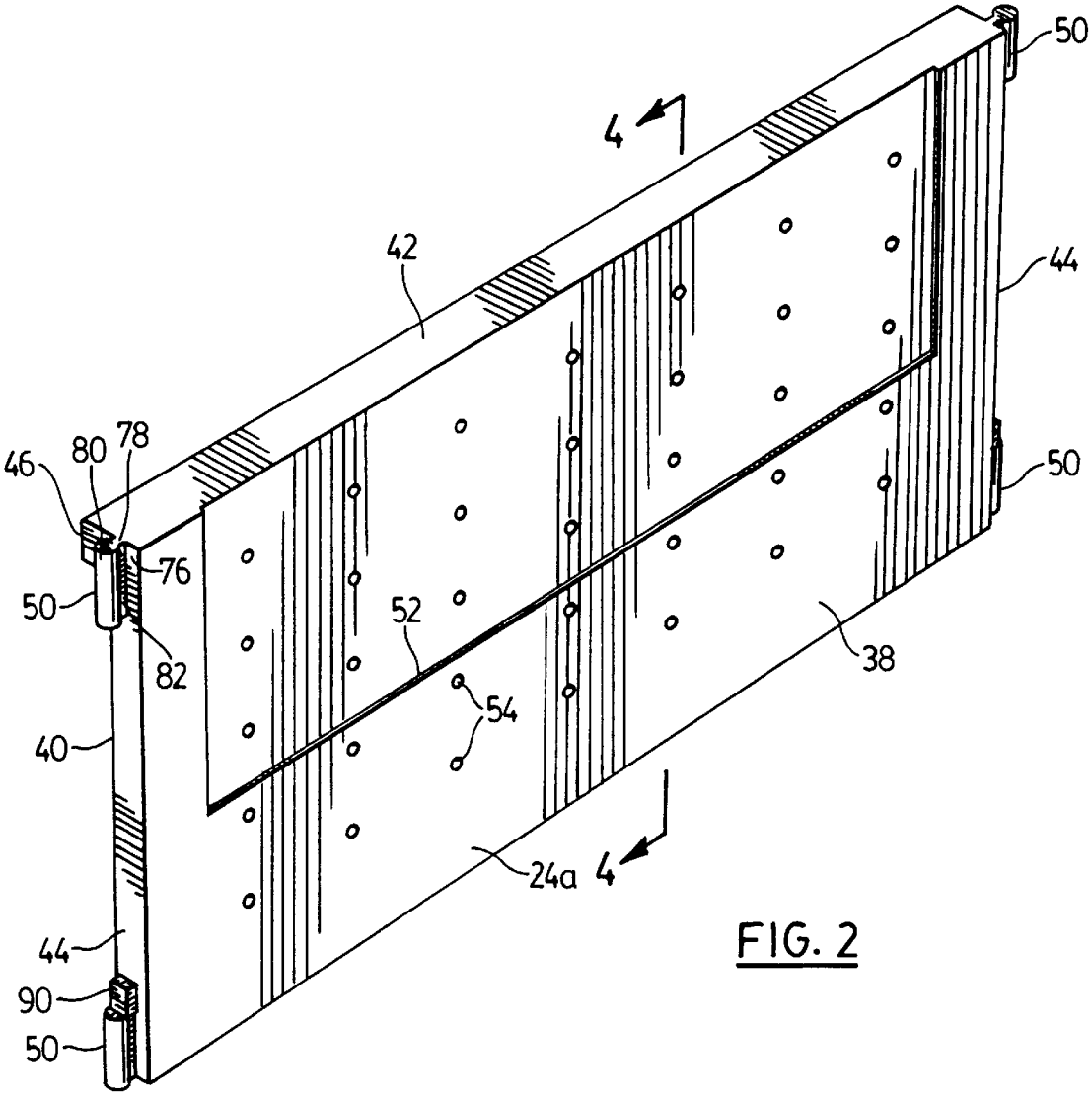
FIG. 2 is an isometric view of a straight panel for the wall board system of FIG. 1.
Figure 3:
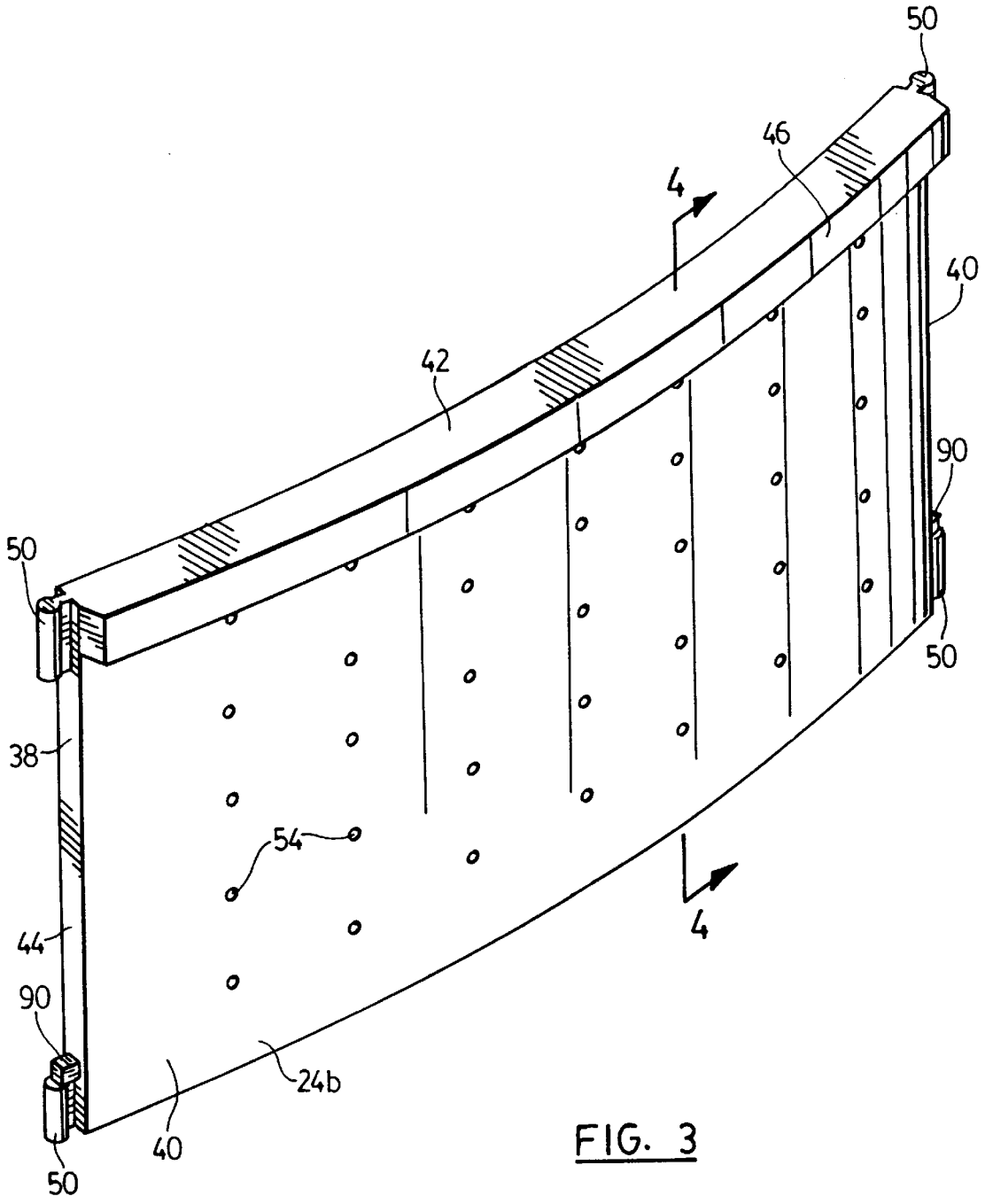
FIG. 3 is an isometric view of a curved panel for the wall board system of FIG. 1.

FIGS. 2 and 3 show typical panel types 24*a* and 24*b*, respectively, each having a substantially smooth front playing face 38, a flat back face 40, a flat top face 42, a flat bottom face 43 and a pair of end faces 44. An upper lip 46 extends perpendicular to the back face to provide structural rigidity to the panel along its length. The playing face, when the panel is adjacently interconnected to other panels 24, defines a portion of the continuous inner wall 36. Regularly spaced along the underside of the panel lip is a series of shield connection hooks 48, the structure and function of which will be described below.

On each end face 44 of the panels 24 is a pair of panel connection keys 50, the structure and function of which will be described in more detail below. The panels 24 may also have a shallow rectangular recess 52 on the front face, dimensioned to accept standard-sized commercial bus advertisements. A rectangular piece of clear acrylic (not shown), or other plastic is removably mounted flushly within the recess 52 to protectively cover the advertisement. The acrylic or plastic cover is mounted preferably by several self-tapping countersunk screws or the like.

In a preferred embodiment, the panels 24 have a single-piece construction and are composed of a suitable thermoplastic material, such as low density polyethylene (LDPE), fabricated using rotational molding techniques. Rotationally molding the panels 24 allows substantially hollow panels 24 to be formed, preferably with a nominal wall thickness of 3/16 of an inch. This material and mode of fabrication is preferred to give the panels 24 both a sturdy and lightweight construction. Also, damaged panels 24 can be melted down and recycled as desired.

Figure 4:
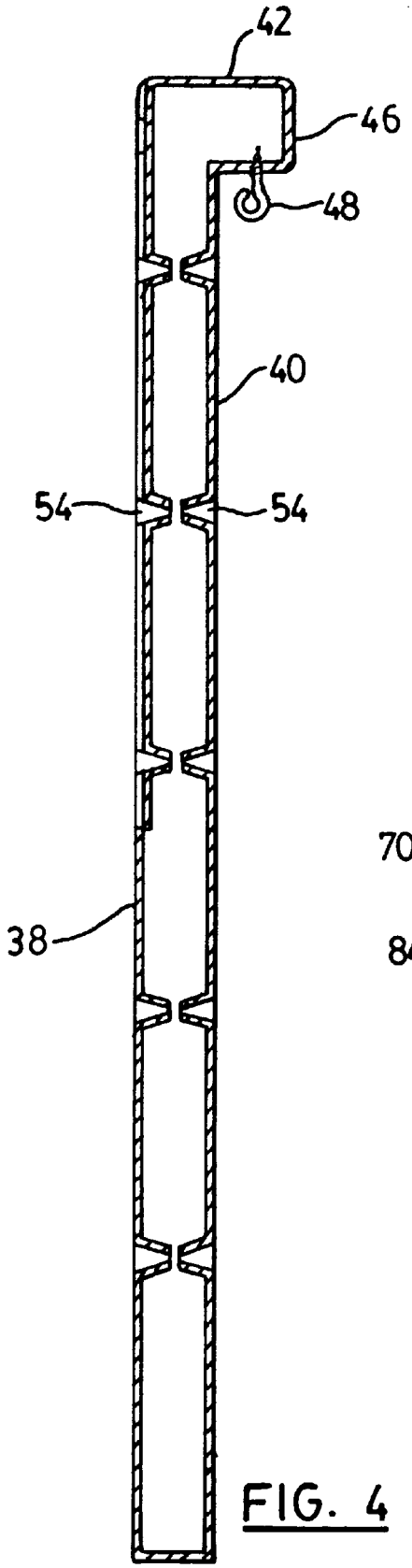
FIG. 4 is a sectional view of the panel of FIG. 2 taken along lines 4—4.

To improve the structural rigidity of the hollow panel and to prevent the panel faces from warping, the front face and back face of the panel preferably have a plurality of regularly-spaced depressions or "kiss-offs" 54 having bases 55, as shown in FIG. 4. The kiss-offs 54 are preferably frustum-shaped, and are placed in opposing pairs on the playing face and back face on each panel. In certain instances, the opposing bases 55 of the opposing kiss-offs may meld together during manufacture. The bases 55 of the paired kiss-offs 54 are adapted to contact one another through the interior of the panel. By using kiss-offs 54 and an LDPE panel wall of 3/16" thickness, a lightweight panel with sufficient structural rigidity is formed. It has been found that this construction of panel responds to contact with a vulcanized rubber puck or ball in a manner very similar to that of an ice hockey dasher board system. That is, a puck or ball will generally bounce off of the panels 24 of the present invention in a manner to which an experienced ice hockey player will be accustomed.

Figure 5:
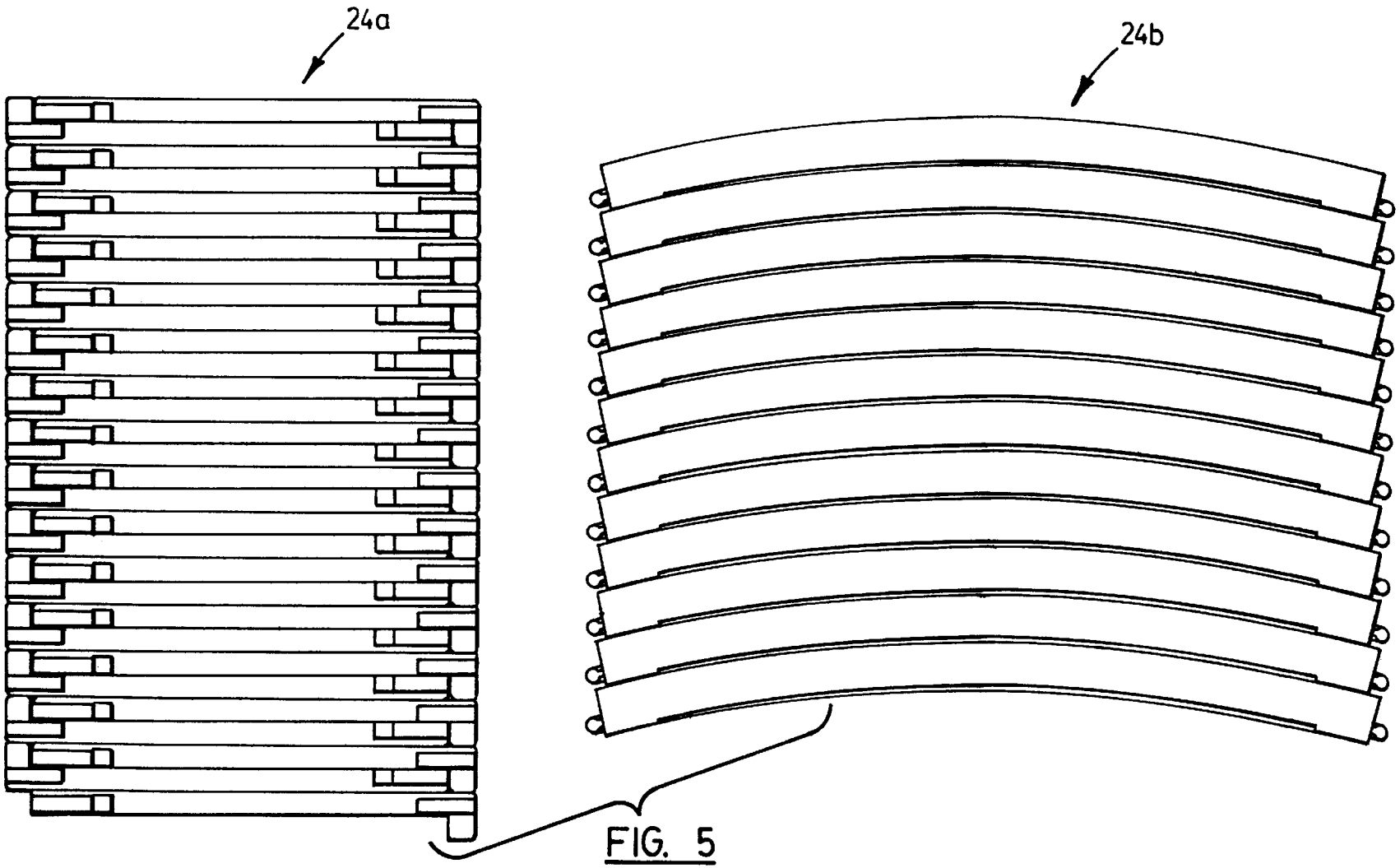
FIG. 5 is a side view of stacks of both straight and curved panels of FIGS. 2 and 3 for storage or transportation.

Any suitable panel height may be chosen for the wall board system 20, however a height of 4 feet is preferred if the wall board system 20 is to accurately mimic a conventional hockey dasher board system. The length of both panel types 24*a* and 24*b* is preferably chosen to allow an individual panel to be carried by two people, and more preferably by one person. A panel length of 7 feet, excluding panel connection keys 50, is preferred. This length also facilitates the transportability of panels 24 by tractor-trailer or other desired means. Furthermore, the use of only two standard panel types, 24*a* and 24*b*, allows the panels 24 to be compactly stacked for storage or transportation, as shown in FIG. 5.

Figure 7:
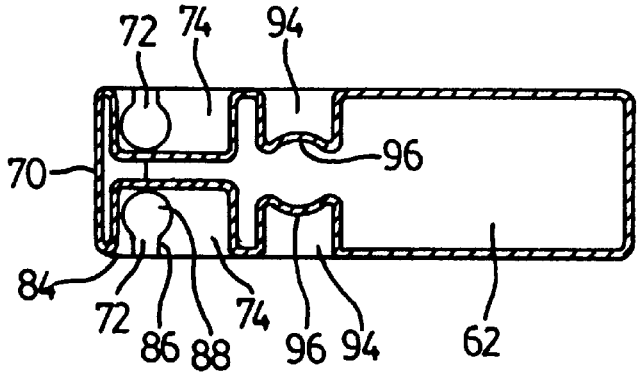
FIG. 7 is a sectional view of the support of FIG. 6 taken along lines 7—7.
Figure 6:
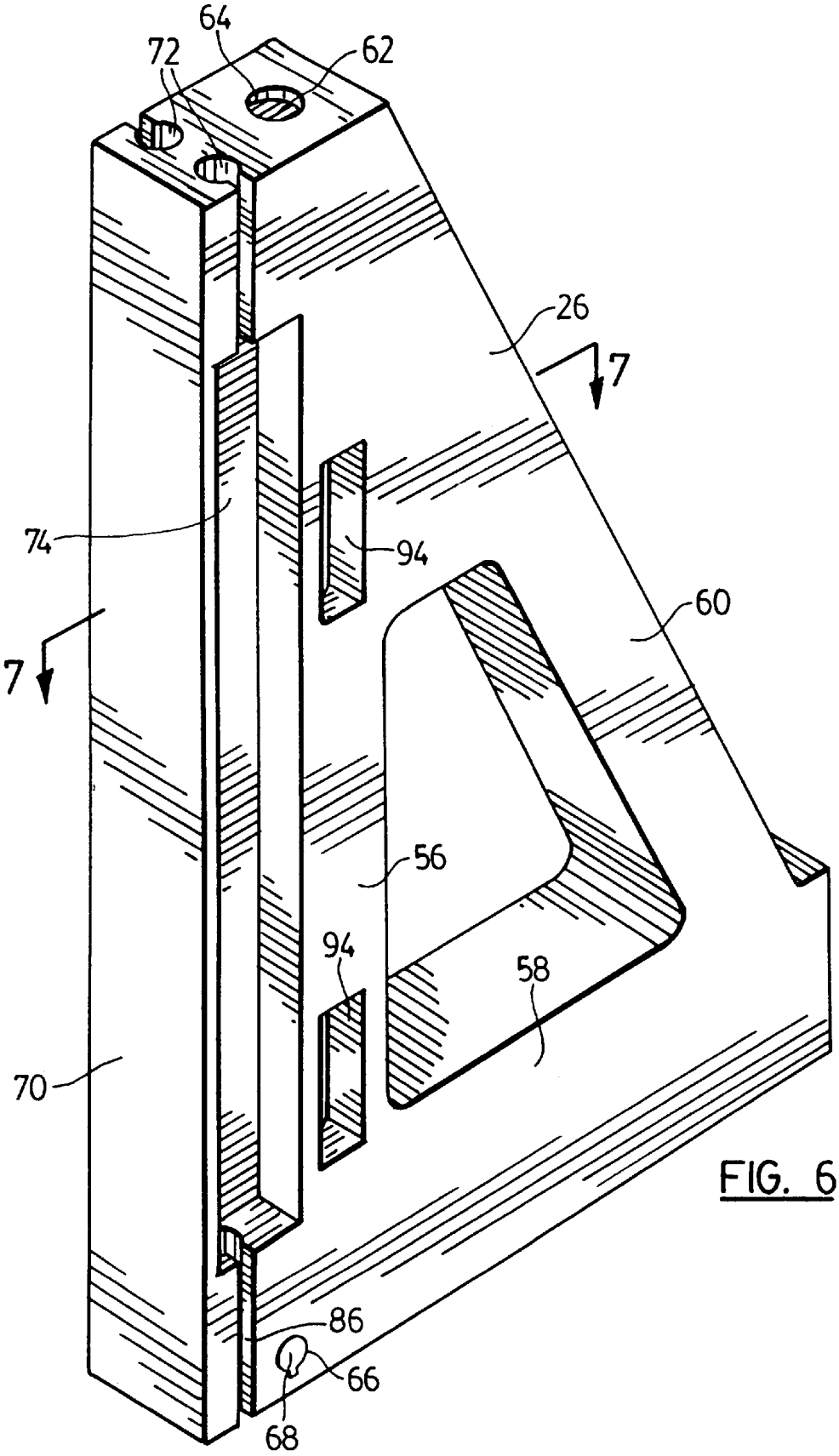
FIG. 6 is an isometric view of a support for the wall board system of FIG. 1.

Referring to FIGS. 6 and 7, a support 24 is shown. As shown in FIG. 1, the supports 26 hold the panels 24 upright and in place in the wall board system 20. The support 24 includes a connection post 56 that extends vertically upward from a horizontal base 58. An integral brace 60 extends diagonally between the top of the post and the rear of the base to enhance the stability of the support 24. The support 24 is preferably substantially hollow, with an interior cavity 62, shown in FIG. 7. In a preferred embodiment the hollow, single-piece support 24 is made of rotationally-molded LDPE.

To provide ballast for supporting the assembled wall board system 20, the support cavity may be filled with a ballast material, preferably water, via an access port 64. The added ballast allows the support 24 to better anchor the panel against incidental player contact which may occur during play. Prior to disassembly of the wall board system 20, the ballast material may be drained from the cavity by means of a drain port 66, which is sealed with a releasable closure 68. If further ballast is desired an external ballast, such as a sand bag (not shown), may be placed on the base portion of the support 24. Alternatively, the wall board system 20 may be more permanently installed by anchoring the supports 26 to a subfloor system or to the ground with appropriate anchor means such as clamps, bolts, pins or concrete footings.

The support 24 has an inner face 70 that is preferably flat, rectangular and substantially smooth. When the support 24 interconnects with two adjacent panels 24, as will be described below, the inner face 70 forms a portion of the continuous inner wall 36 of the playing surface 22. A pair of panel connection keyways 72, defined into each of the two side faces of the support 24, are provided to mate with the panel connection keys 50. A rectangular recess 74, running vertically up both side faces of the connection post 56 portion of the support 24, provides access to the keyways 72. The keyways 72 are offsettedly located in the recess, towards the inner face 70 of the support 24.

Figure 8:
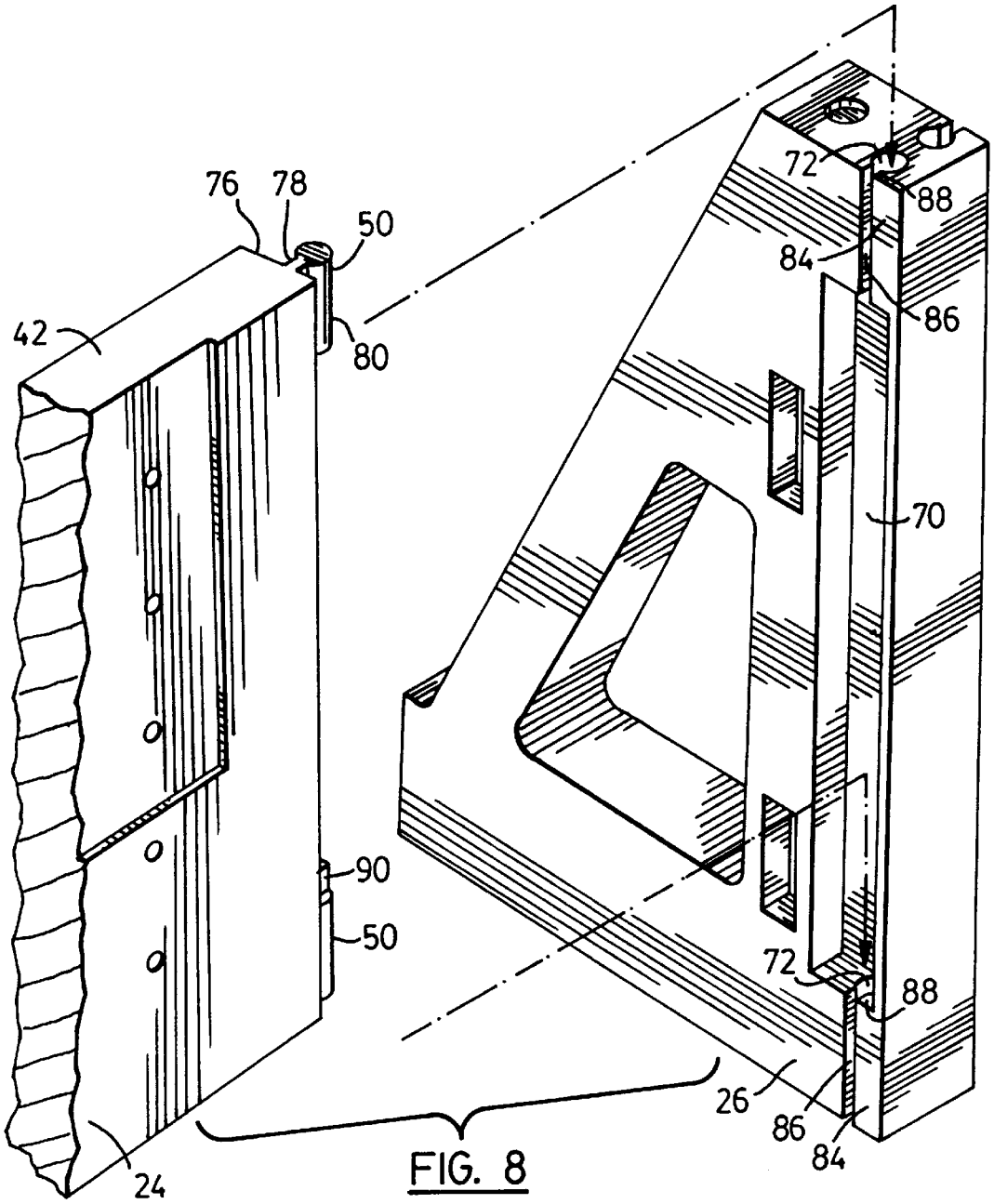
FIG. 8 is an exploded isometric partial view of the connection between the panel and the support of FIGS. 2 and 6.

A preferred mode of interconnection is shown in FIG. 8. The panel connection key 50 has a shoulder portion 76, a neck portion 78 and a head portion 80. The should portion 76 is flat and perpendicular to rectangularly prismatic faces 82 of the neck portion 78. The head portion 80 is substantially cylindrical in shape and aligned with its axis parallel to the long axis of the neck portion 78. The corresponding keyway 72 located on the support 24 has a shoulder portion 84, a slot portion 86 and a locking portion 88. The shoulder portion 84 is flat and perpendicular to the parallel, flat, rectangular faces of the slot portion 86, and the locking portion 88 is substantially cylindrical in shape. The neck portion 78 and head portion 80 of the key 50 are dimensioned to intimately, slidingly mate respectively with the slot portion 86 and locking portion 88 of the keyway 72 in a manner indicated in FIG. 8. A stop block 90, on the upper edge of the lower key 50 of each panel end, prevents the lower key 50 from sliding completely through its corresponding keyway 72. The stop block 90 ensures alignment between the top faces 42 of the interconnected panels 24 and supports 26, irrespective of the flatness of the terrain upon which the wall board system 20 is being installed. It will be understood that different corresponding configurations of the keys 50 and keyways 72 may be selected as desired. For instance, the head portion 80 of the keys 50 could have a triangular cross-sectional shape to mate with a corresponding triangular cross-section locking portion 88 of a keyway 72.

Figure 9:
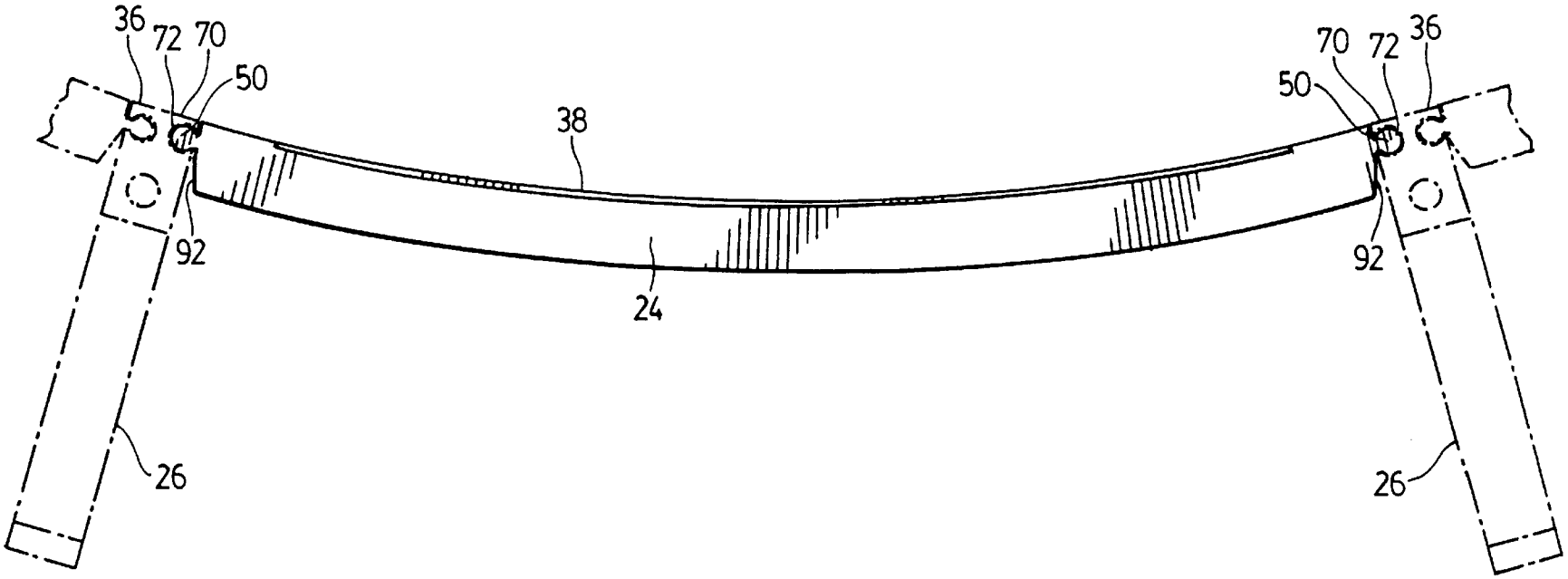
FIG. 9 is a plan view of interconnected panels and supports of FIGS. 3 and 6.

Once the pair of keys 50 are slid as indicated into the corresponding keyways 72, the panel is interconnected to the support 24, as shown with a curved panel 24*b* in FIG. 9, and panel movement is constrained both downwardly and transversely relative to the support. Since panel types 24*a* and 24*b* have identical keys 50, either panel type may be connected to a support 24. This interchangeability allows the wall board system 20 to be adapted to almost any size or shape of playing surface 22. It will be noted that the end faces 44 of the curved panel type 24*b* includes an inwardly tapered portion 92 to allow a degree of angular movement relative to the support 24 according to the overall radius of curvature desired for the continuous inner wall 36 of the rink.

Referring again to FIGS. 6 and 7, a pair of guide recesses 94 are also defined in opposing pairs on each of the two side faces of the support 24. The guide recesses 94 serve to guide and anchor the shield support posts 34. As shown in FIG. 7, the guide recesses 94 each have a convex cylindrical bottom surface 96, the fixed inner radius of which is preferably equivalent to or slightly larger than the radius of the support access port 64. The guide recesses 94 are positioned on the connection post 56 such that the convex surface of each guide recess is concentric with the access port 64. As will be described below, this alignment allows a cylindrical shield support post to be vertically held by the support 24 by inserting the post through the access port 64, into the interior of the support cavity and then sliding the post between the opposing pairs of guide recesses 94 until the base of the post rests against the interior floor of the base portion of the support 24. The structure, function and installation of the shield support posts 34 will be discussed in more detail below.

Figure 10:
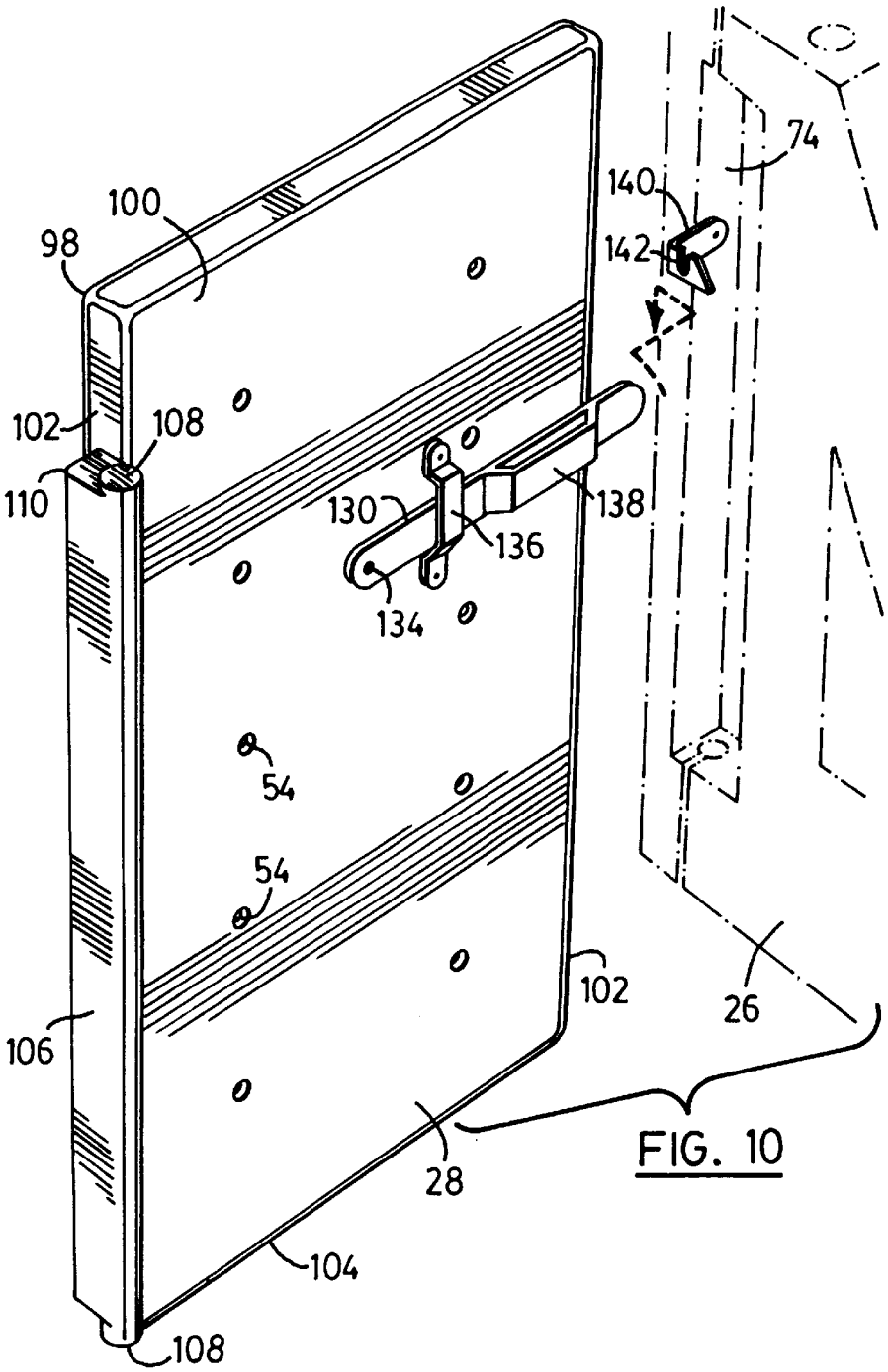
FIG. 10 is an exploded isometric view of an access door and support for the wall board system of FIG. 1.

FIG. 10 shows a preferred embodiment of the door 28 for allowing a player to enter and exit the playing surface 22. The door 28 has a flat, substantially smooth door face 98, a flat back face 100, flat sides 102, a door lip 104 and a hinge arm 106 having upper and lower hinge pins 108. The door 28 is designed to open outwardly, away from the playing area. As with the panel and support elements, the door 28 is preferably composed of rotationally molded LDPE so that the door element is substantially hollow with nominal wall thickness of 3/16 of an inch.

Figure 11:
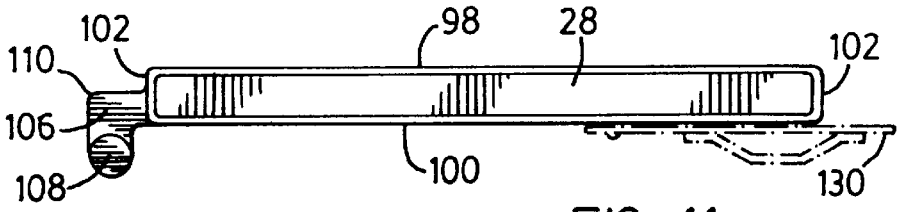
FIG. 11 is a top view of a the access door of FIG. 10.

When the door 28 has been installed, as will be described below, and closed, the door face 98 forms a portion of the continuous inner wall 36 of the rink. The door face 98 and back face have a plurality of opposing kiss-offs, as shown in FIGS. 10 and 11, to improve the door's structural rigidity and prevent the faces from warping similar to the kiss-offs 54 used in the panel elements. The door lip 104 extends along the length of the door's bottom face to prevent the door 28 from swinging inwardly into the playing area.

Figure 14:
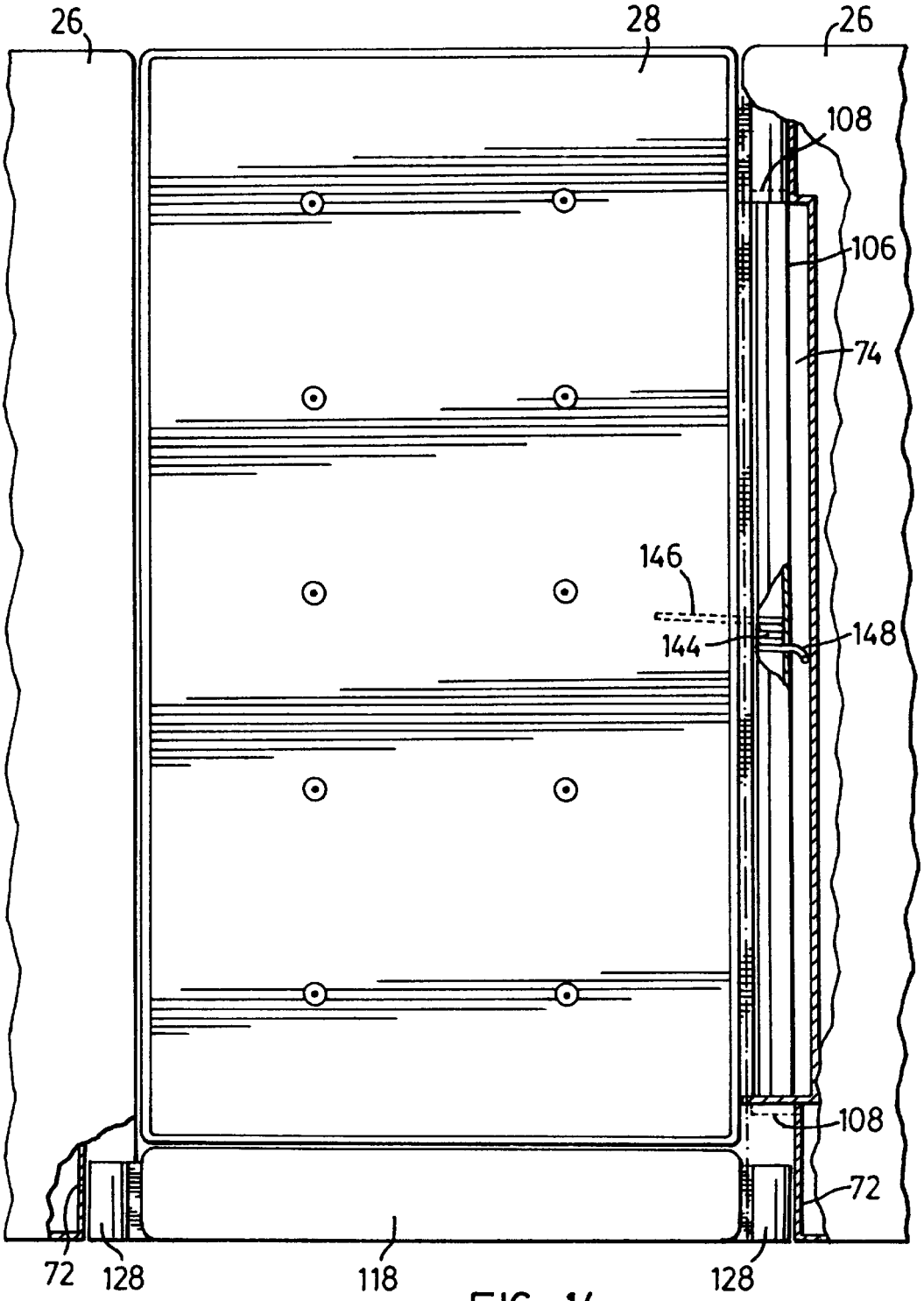
FIG. 14 is a front view of the access door and door brace of FIGS. 10 and 13 installed between a pair of supports.

The hinge arm 106 has a 90-degree elbow 110, as shown in FIG. 11, which holds the hinge pins 108 out of the plane of the door 28. The vertical height of the hinge arm 106, excluding the hinge pins 108, is approximately equal to but not greater than the height of the support recess. The portion of the hinge arm 106 outside of the elbow 110 has a width less than the width of the support recess 74. The hinge arm 106 is sized in this manner so that it fits within the support recess 74 when the door 28 is in the closed position, as shown in FIG. 14. The elbowed shape of the hinge arm 106 allows the door 28, once it has been installed as described below, to swing closed such that the door face 98 is flush with the inner faces 70 of adjacent supports 26. The cylindrical hinge pins 108 are concentrically located on the top and bottom ends of the hinge arm 106.

Figure 12:
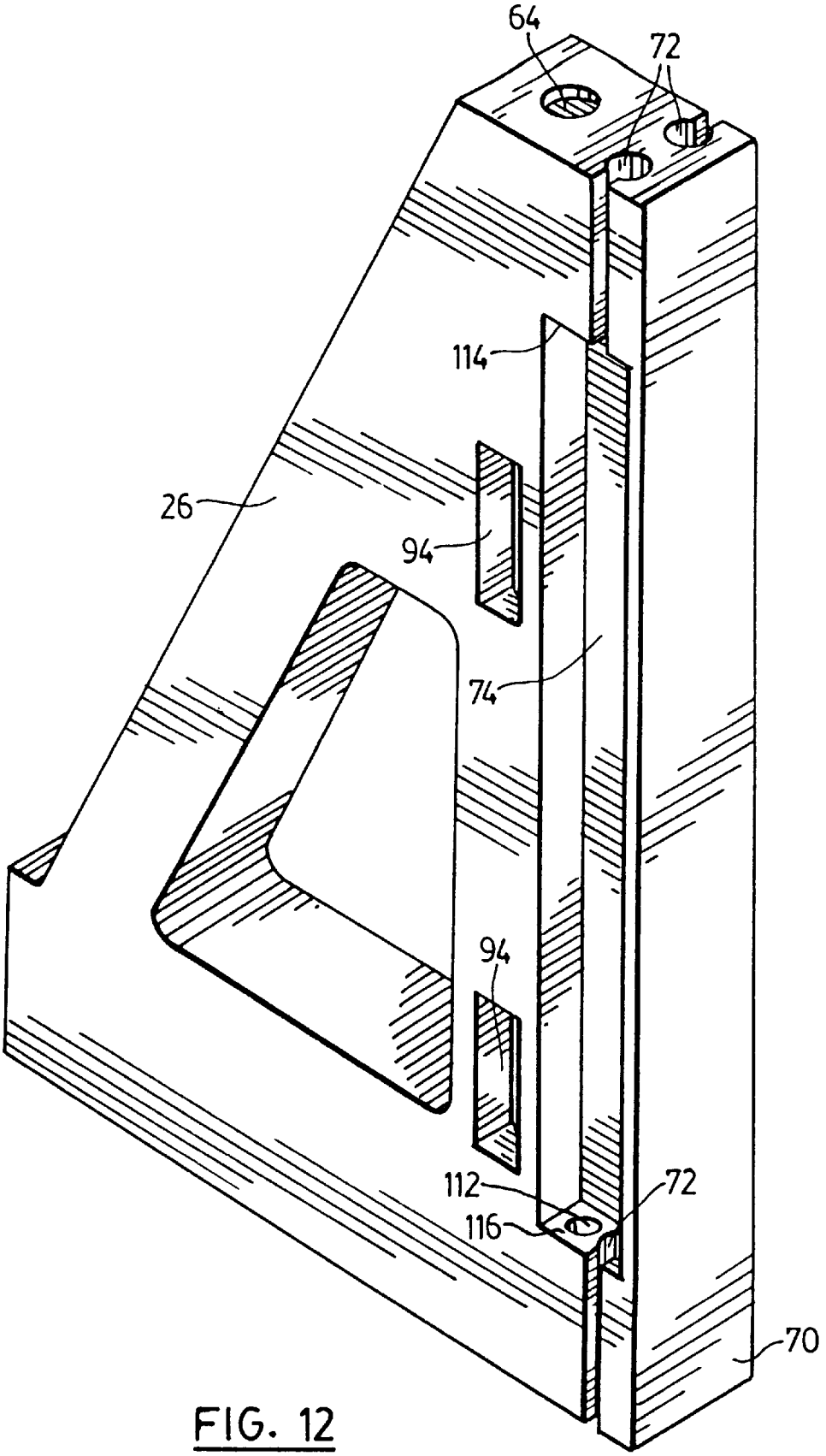
FIG. 12 is a left side perspective view of a support that has been modified to receive the door of FIG. 10.

The door 28 is semi-permanently installed in a specially modified support 24 as shown in FIG. 12. A support 24 is modified by cutting a circular hole 112 in top and bottom faces 114 and 116 of one of the vertical recesses on the support 24. The holes are sized to allow the hinge pins 108 to snugly enter therein and are located adjacent the keyways 72. The door 28 is installed in the support 24 by locating the lower hinge pin in the lower hole and rotating the door 28 thereabout until the upper pin has been forced-fitted into the upper hole. To facilitate this forced-fit installation of the door 28, the height of the hinge pins 108 is preferably no greater than about ½ inch.

Figure 13:
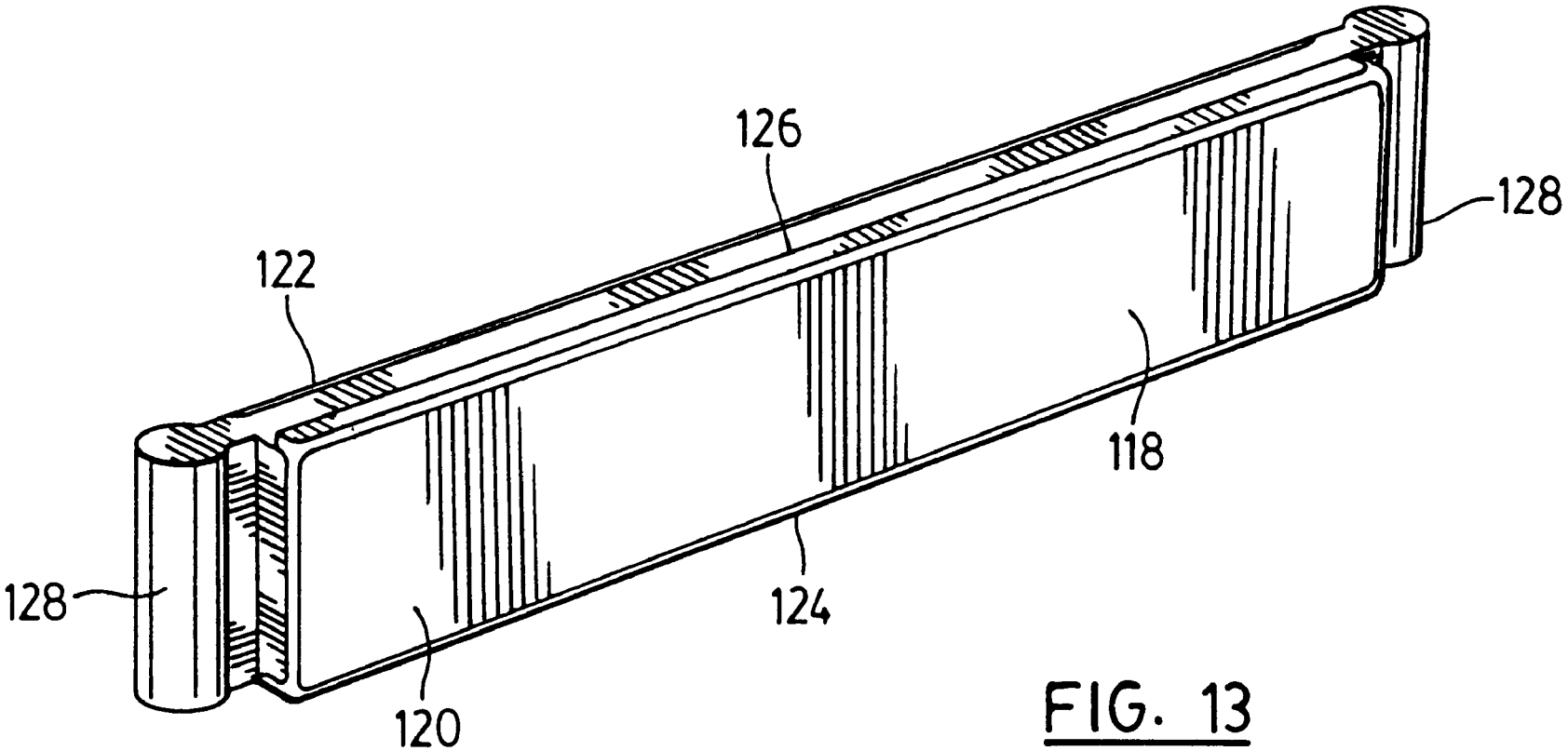
FIG. 13 is an isometric view of a door brace for the wall board system of FIG. 1.

An under-door brace 118 is shown in FIG. 13 for connecting to the lower keyways 72 of the two supports 26 which define the doorway shown in FIG. 14. The brace fixes the distance between the supports 26 and stabilizes the size and shape of the doorway, which enables the door 28 to freely and fully close between the supports 26. The under-door brace 118 has a substantially smooth front face 120, a back face 122, a flat bottom face 124, a brace lip 126 running along the length of the upper face, and a connection key 128 located on either end. The brace lip 126 and door lip 104 together prevent the door 28 from swinging into the playing area. The brace lip 126 and door lip 104 are dimensioned to mate and are disposed against each other when the door 28 is in the closed position, the door face 98 being flush with the adjacent support faces.

The connection key 128 of the under-door brace is identical to the panel connection key 128 in all aspects of shape and dimension except height. The height of the brace keys 50 is the same as the nominal height of the brace. The brace height is sized so that it extends from the ground to the bottom face of the door 28.

A door locking mechanism 130 is shown in FIG. 10 for locking the door 28 in the closed position. The mechanism preferably comprises an arm 132, having a pivot 134, a guide 136, a handle 138, a catch 140 and a catch slot 142. It will be recognized that many other configurations of door 28 locking mechanism 130 would also be effective. The arm 132 is pinned to the back face 122 of the door 28 at one end and freely slidably held by the guide 136 part-way along its length, and is positioned on the door 28 such that the free end of the arm 132 extends outwardly sideways of the door 28. The guide 136 restricts the range of motion of the pinned arm 132. The catch is mounted on the inner front face 120 of the support recess so that it may engage and hold the free end of the arm 132. To close the mechanism, the arm 132 is lifted by the handle 138 and the door 28 is closed until the arm 132 is located over the catch slot 142. The handle 138 is then released and the arm 132 falls into, and is held by, the catch slot 142. To open the mechanism, the arm 132 is lifted out of the catch slot 142, using the handle 138, and the door 28 is swung open and the handle 138 released.

The door 28 may also be biased to automatically close after being opened. Although it will be readily recognized that the door 28 may be biased in any number of ways, a preferred method of biasing the door 28 is through the use of a torsion spring 144, as shown in FIG. 14. The torsion spring 144 may be inserted into the door 28 with one arm 146 of the spring left to bear against the interior of the door panel. The other arm 148 of the spring protrudes from the door 28 and may be positioned to bear against the interior of the support recess.

Figure 15:
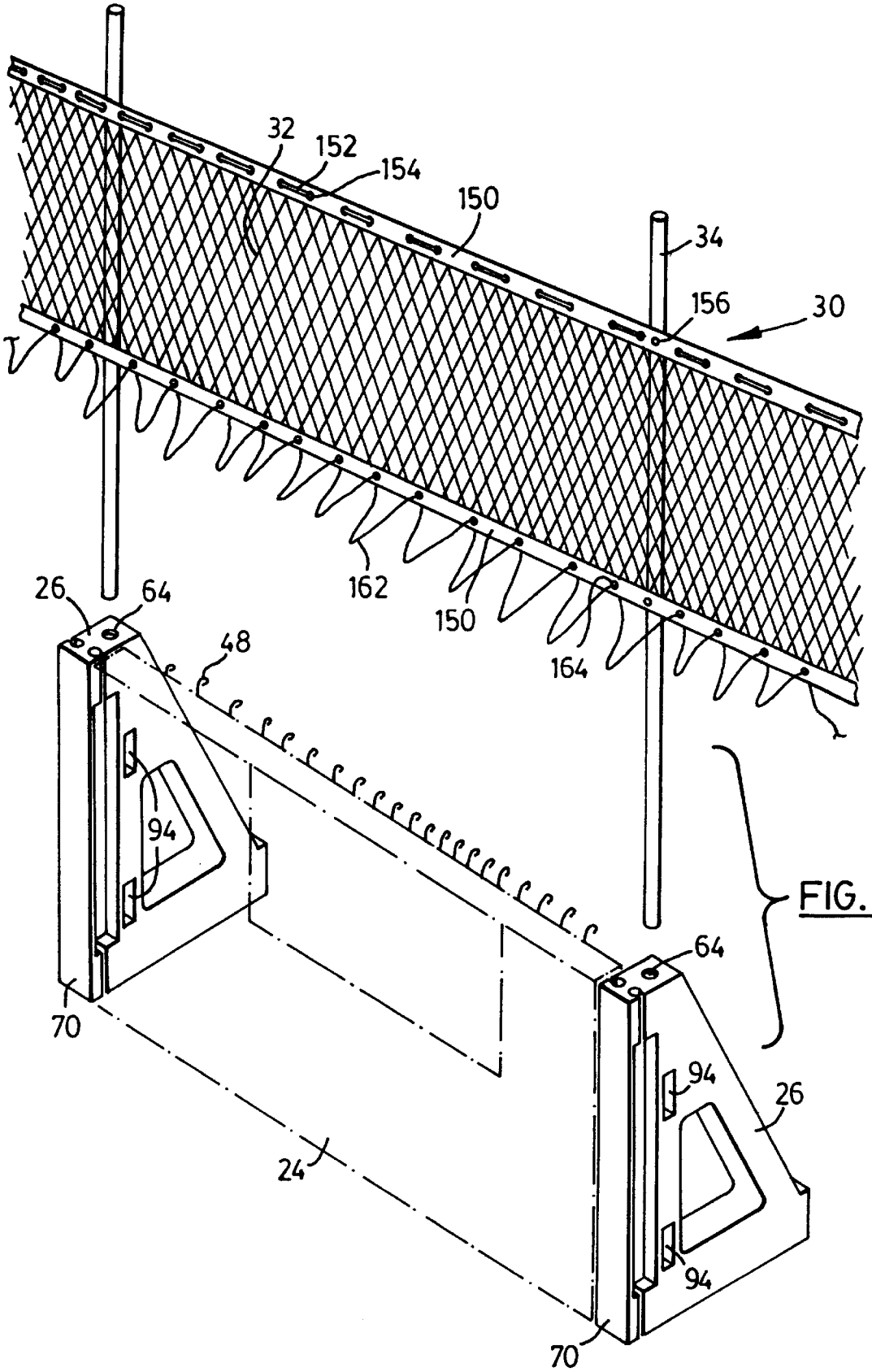
FIG. 15 is an exploded isometric view of a shielding system for the wall board system of FIG. 1.

As discussed above, the wall board system 20 may be provided with a shielding system 30, as shown in FIGS. 1 and 15, to protect spectators from the ball or puck and to generally keep the ball or puck in play. A preferred material for the shield is commercially available knotted-rope netting having top and bottom nylon tape trim 150. It will be readily recognized that any number of other materials may be used for the shield, such as sheets of plate acrylic or plastic fitted to corresponding grooves in the support posts.

As shown in FIG. 15, the shield may be supported by shield support posts 34, which are affixed to the supports 26 and rise upwardly therefrom. Although the shield support posts 34 may be constructed in any number of manners, the use of commercially available acrylonitrile-butadiene-styrene (ABS) plumbing piping is preferred where rope netting is the shielding material. In a preferred embodiment, the shield support posts 34 are vertically supported by the supports 26. The posts preferably have an outside diameter which allows a post to matingly fit through the access port 64 in the support 24 into the interior of the support cavity. Once inside the cavity, the posts are slid down through the two pairs of guide recesses 94 in the support 24, until the base of the shield support post rests against the interior floor of the base portion of the support 24. When inserted in this manner, the guide recesses 94 anchor the shield support post. Since the shield support posts 34 are located in the access port 64 of the support 24, it will be apparent that if the addition of a liquid ballast is desired, the support 24 must be filled with the ballast prior to the insertion of the shield support posts 34.

The netting may be attached to the shield support posts 34 in any number of ways. A preferred method is attaching a continuous piece of netting to the support posts by feeding a guidewire 152 through regularly-spaced grommets 154 along the top trim of the net and supporting the guidewire 152 through a hole 156 made through each support post. It will be apparent that the guidewire 152 will have to be fed through the net grommets 154 and support posts in an appropriate sequence. The guidewire 152 is fixed to the first post 158 (see FIG. 1) in a length of shielded area, and fixed to a small hand winch (not shown), or the like, at a last post 160. When the net and posts have been properly threaded with the guidewire 152, the winch is tightened to provide an appropriate tension to the guidewire 152.

In another preferred method of attaching netting to the support posts, several netting elements, each having the length of one panel element, are used. The net elements would include a side trim and would be secured on each end to a shield support post in an appropriate manner.

It is preferred that netting also be attached at its lower end to the panel lip to prevent the ball or puck from escaping between the interface of the netting and panels 24. This attachment may be made by securing the netting to a series of hooks which have been affixed to the underside of the panel lip at regular intervals along the panel lip's length. A rope or cable 162 may be fed through regularly-spaced grommet holes 164 along the lower edge of the net and secured to the hooks in a stitch-like manner by the rope or cable 162.

In a preferred embodiment, the shield support posts 34 are ten feet in length such that, when used with panels 24 four feet in height, the posts extend six feet above the top edge of the interconnected panels 24. The hole 156 in the shield support post through which the net supporting guidewire 152 is fed is located two feet from the top of the post, being four feet above the height of the top of the interconnected panels 24. This results in a netting shield extending four feet above the height of the interconnected panels 24, and leaves an exposed portion of the support posts extending two feet above the netting shield. The top portion of each post may be used as a flag standard (as shown in FIG. 1), a support 24 for artificial lighting to light the playing area, mount for a commercial advertisement or any other desired purpose.

The method of assembling the wall board system 20 is as follows. A desired size of playing area is selected and panels 24 are laid out around the playing area in the appropriate sequence so that the playing area will be defined in the desired shape. For instance, for a 140 foot by 65 foot playing surface a total of fifty-four panels (that are seven feet in length) are used. Each corner for such a rink uses three curved panels **24*b* thus requiring twelve curved panels 24*b* and forty-two straight panels 24*a* to form the rink. The length of the rink would vary of course according to the number of doors 28 added. A support 24 is also set at the intended place of each interconnection between panels 24. A first panel is connected to a first support 24 by lifting the panel, lining the panel keys 50 up with the support keyways 72 and sliding the panels 24 fully downwardly in to the keyway 72. The first panel is then connected at its other end to a second support 24 in a similar manner. A second panel is then connected to the second support 24 and a third support 24, as described, and the process is repeated until the last panel is connected to the first support 24, and the interconnected panels 24 and supports 26 contiguously define the playing area. If one or more doors 28 are to be included in the wall board system 20, then the doors 28** are inserted at the appropriate places, in lieu of the insertion of a panel.

Once the panels 24, supports 26 and doors 28 have been interconnected, ballast may be added to the system by filling the supports 26 with water and positioning external ballasts as described above. If a shielding system 30 is desired, the shield support posts 34 may then be inserted into the supports 26 in the manner previously described. The guidewire 152 is then fed through the netting and shield support posts 34 and the guidewire 152 is tightened. Once the posts and netting have been erected, the netting may be tied to the net hooks in the manner described above.

It is to be understood that what has been described is a preferred embodiment of the invention. The invention is nonetheless susceptible to certain changes and alternative embodiments fully comprehended by the spirit of the invention as described above, and the scope of the claims set out below.

We claim:

1. A wall board system for enclosing an area, comprising:

a plurality of panels each having a front face and at least two end faces;

a plurality of supports each having a front face and at least two side faces, wherein said supports are generally hollow for receiving a ballast material; and means for interconnecting said end faces of said panels to said side faces of said supports to align said panel front faces and said support front faces to define a substantially continuous inner wall for enclosing said area.

2. A system as claimed in claim 1, wherein said panels are arranged in an alternating sequence of one panel and one support to define said continuous wall.

3. A system as claimed in claim 1, wherein said interconnecting means is integrally formed with each of said panels and said supports.

4. A wall board system for enclosing an area, comprising:

a plurality of panels each having a front face and at least two end faces;

a plurality of supports each having a front face and at least two side faces; and a system for interconnecting keys and keyways integrally formed on said panels and said supports to align said panel front faces and said support front faces to define a substantially continuous inner wall for enclosing an area.

5. A system as claimed in claim 4, wherein said integral keys are located on the end faces of said panels.

6. A system as claimed in claim 4, wherein said integral keyways are defined on the side faces of said supports.

7. A system as claimed in claim 4, wherein said integral keys and keyways have corresponding head portions and neck portions, said head portions being larger than said neck portions in transverse cross-section to facilitate their lockable interconnection.

8. A system as claimed in claim 4, herein said integral keys have a generally cylindrical head portion and said integral keyways have a corresponding generally cylindrical cavity portion for slidably receiving said head portion.

9. A wall board system for enclosing an area, comprising:

a plurality of panels each having a front face and at least two end faces;

a plurality of supports each having a front face and at least two side faces; and means for interconnecting said end faces of said panels to said side faces of said supports to align said panel front faces and said support front faces to define a substantially continuous inner wall for enclosing said area;

wherein said panels and said supports are each formed as a single piece of molded plastic.

10. A system as claimed in claim 9, wherein said panels are hollow.

11. A system as claimed in claim 10, wherein said panels include a plurality of kiss-offs defined in said front face and in an opposing back face, wherein pairs of said kiss-offs oppose each other on said front and back faces to abut each other within the hollow interior of said panel.

12. A wall board system for enclosing an area, comprising a plurality of panels each having a front face and at least two end a plurality of supports each having a front face and at least two side faces;

means for interconnecting said end faces of said panels to said side faces of said supports to align said panel front faces and said support front faces to define a substantially continuous inner wall for enclosing said area; and at least one door having a front face, first and second end faces, and means for pivotally connecting said first end face of said door to one of said supports along a vertical axis to align said door front face with said panel front face and said support front face to define said continuous inner wall.

13. A system as claimed in claim 12, wherein said pivotal connection means comprises a hinge arm having an integral pin for pivotally connecting along a vertical axis with an integral corresponding opening defined on said support.

14. A system as claimed in claim 12, wherein a releasable locking mechanism is located on a back face of said door for releasably locking said door to a said support adjacent to said second end face of said door.

15. A wall board system for enclosing an area, comprising:

a plurality of panels each having a front face and at least two end faces;

a plurality of supports each having a front face and at least two side faces;

means for interconnecting said end faces of said panels to said side faces of said supports to align said panel front faces and said support front faces to define a substantially continuous inner wall for enclosing said area; and a shielding system having at least one shield and a plurality of shield support means, said shield support means interconnecting with said supports to define an upper wall that extends generally co-planar to said continuous inner wall along at least a portion of the circumference of said enclosed area.

16. A system as claimed in claim 15, wherein said shield comprises netting.

17. A support for a wall panel comprising:

a hollow body having a base portion and a post portion, said post portion being generally orthogonal to said base portion and having a front face and at least two side faces;

a brace portion extending diagonally between said post portion and said base portion; and integral interconnection means located on said side faces of said post portion for interconnecting with corresponding interconnection means on a wall panel;

wherein said hollow body is adapted to receive a ballast material.

18. A support as claimed in claim 17, wherein said hollow body is formed as a single piece of molded plastic.

19. A support for a wall panel comprising:

a hollow body having a base portion and a post portion, said post portion being generally orthogonal to said base portion and having a front face and at least two side faces; and integral interconnection means located on said side faces of said post portion for interconnecting with a wall panel, wherein said interconnection means comprises upper and lower keyways that are defined in said side faces adjacent each said post portion for receiving at least two corresponding upper and lower keys on said wall panel;

wherein said hollow body is adapted to receive a ballast material.

20. A support as claimed in claim 19, wherein a recess is defined in each of said side faces immediately above said lower keyway to facilitate vertical slidable interconnection of said upper and lower keys with said upper and lower keyways.

21. A wall panel for a wall board system comprising:

a monolithic panel having at least two end faces; and integral interconnection means located on said end faces of said panel for engaging corresponding interconnection means on a support for said wall panel;

wherein said panel is formed as a single hollow piece of molded plastic.

22. A wall panel as claimed in claim 21, wherein said panel has an opposing front face and back face, and wherein a plurality of kiss-offs are defined in said front and back faces wherein pairs of said kiss-offs oppose each other to abut within the hollow interior of said panel.

23. A method for enclosing an area with a modular wall board system comprising the following steps:

determining the size of the desired area to be enclosed;

obtaining a plurality of panels each having a front face, a plurality of supports and means for interconnecting said panels to said supports to align said panel front faces;

interconnecting said panels and said supports with said interconnection means to align said front faces of said panels to define a continuous inner wall for enclosing said area; and inserting at least one door and at least one door brace between a pair of supports for facilitating entry and exit from said area.

24. A method as claimed in claim 23, wherein said supports are hollow and include a port for accessing the hollow interior, and comprising the further step of filling at least some of said hollow supports with a ballast material.

* * * * *